US005922235A

United States Patent [19]

Scott et al.

[11] Patent Number: 5,922,235

[45] Date of Patent: Jul. 13, 1999

[54] OBJECT BRACKET HOLDER FOR CONCRETE FORMS

[76] Inventors: Samuel C. Scott; William C. Scott, III, both of 1788 Helena St., Aurora, Colo. 80011

[21] Appl. No.: 08/788,419

[22] Filed: Jan. 27, 1997

Related U.S. Application Data

[63] Continuation-in-part of application No. 08/510,006, Aug. 1, 1995, Pat. No. 5,667,190.

[51] Int. Cl.[6] ..... B22D 19/04

[52] U.S. Cl. ..... 249/16; 249/61; 249/83; 249/96; 249/210; 52/312; 52/314; 52/315

[58] Field of Search ..... 249/16, 61, 83, 249/96, 210; 52/312, 314, 315

[56] References Cited

U.S. PATENT DOCUMENTS

| | | | |
|---|---|---|---|
| 2,005,030 | 6/1935 | Geisinger | 52/774 |
| 2,178,535 | 10/1939 | Willson | 264/277 |
| 2,825,221 | 3/1958 | Brouk | 52/293.1 |
| 3,131,514 | 5/1964 | Siek | 50/272 |
| 3,231,646 | 1/1966 | Conder et al. | 264/86 |
| 3,321,883 | 5/1967 | Pascucci | 52/502 |
| 3,496,694 | 2/1970 | Hicks et al. | 52/746 |
| 3,594,968 | 7/1971 | Johnson | 52/390 |
| 3,602,476 | 8/1971 | Iraqorri | 249/96 |
| 3,694,533 | 9/1972 | Kelsey | 264/90 |
| 3,868,801 | 3/1975 | Weiner | 52/309 |
| 4,644,719 | 2/1987 | Salazar | 52/311 |
| 4,916,875 | 4/1990 | Kashiwagi | 52/302 |
| 4,947,600 | 8/1990 | Porter | 52/235 |
| 5,009,387 | 4/1991 | Scott et al. | 249/96 |
| 5,311,714 | 5/1994 | Passeno | 52/314 |
| 5,536,557 | 7/1996 | Nasvik et al. | 428/141 |

FOREIGN PATENT DOCUMENTS 491397 9/1938 United Kingdom .

OTHER PUBLICATIONS

Ceramic Tile Installation Methods—Practiced in Japan (Publication date unknown).

*Primary Examiner*—David W. Wu
*Attorney, Agent, or Firm*—Pittenger & Smith, P.C.

[57] ABSTRACT

An individual bracket for holding and securing an object to the surface of a construction form for embedding the object in a settable material, such as concrete, and exposing the face surface of the object in the finished construction. The bracket has an outer configuration formed from a plurality of side and end perimeter members that defines a recess that correspond with the outer configuration of the object. The perimeter members have a flat outer surface extending at right angles to the form and an inwardly extending flange which is parallel and in contact with the form. An upwardly curved inner surface extends from the flange to the outer edge of the flat outer surface which forms one-half of a mold to form a grout line when two brackets are connected together. The actual mold can be any shape desired to provide the various types of grout lines. An object can be held within the bracket by the use of adhesives, coatings, detentes, elastic bands or any other arrangement which will provide secure retainment of the object within the bracket during use. Another embodiment of the bracket includes a relatively rigid base portion and a resilient cap portion. The base portion includes a flange area as well as a partial outer mating surface. The cap portion forms the upper portion of the perimeter member, including the extension of the outer mating surface as well as the rounded extended surface forming the mold area for the grout line. The cap portion is formed from a resilient flexible elastomeric material that can have an outwardly projecting continuous ridge extending around the interior perimeter of the bracket.

12 Claims, 7 Drawing Sheets

4
16
C
18
16
10
B
4
12
22
20
14
C
18
24
36
89
60
56
64

30
42
89
46
44
32
38
76
89
52
74
76
24
58
34
40
54
62
89
86
76
40
89
62
34
74
76
32
48
44
54
86
42
52
72
89
70
72
42
38
60
89
30

88
36
72
88
70
56
88
72

OBJECT BRACKET HOLDER FOR CONCRETE FORMS

CROSS-REFERENCES

This is a Continuation-In-Part application of U.S. patent application Ser. No. 08/510,006, filed Aug. 1, 1995 now U.S. Pat. No. 5,667,190.

FIELD OF THE INVENTION

This invention is directed to a bracket for retaining an object in position on the inside surface of a concrete form. It is more specifically directed to an interconnecting bracket properly positioned on the inside surface of a concrete form to hold an object which is to be embedded in the surface of a finished concrete structure.

BACKGROUND OF THE INVENTION

Simulated brick construction in conjunction with concrete forming and fabrication of structures is becoming increasingly common in the construction of modern buildings. This is due to the fact that it is quite expensive to use the services of masons in order to build a true laid-up brick or masonry wall. With the scarcity of skilled workers today, the ability to fabricate a true brick or masonry wall is quite problematic. In order to get around these increased costs and problems, many construction companies have gone to the use of simulated brick building panels which are backed by concrete and positioned as required to form a wall or structure which has a simulated brick exterior appearance. A major problem with this type of construction is that the panels are quite difficult to handle and position at the construction site.

Construction of this type of wall has improved recently by the use of brick or object retainers which are fastened directly to the inside surface of the concrete wall form. In this way, as the concrete is poured into the form it flows around the back of the brick which is embedded in the outer surface of the structure. The problem with this type of construction is that many retainers are known to fail and cause the bricks to fall to the bottom of the form cavity during the pouring process. Thus, a large void is left in the finished wall surface or concrete is exposed where the missing brick should be located. This is especially true with many of the different retainers that have been tried in the past and which comprise the prior art in this area of construction. In addition, the panels and retainers which have been used up to now have been quite expensive and difficult to install. In most of these, the bricks must be inserted into recesses within the panel or retainers within the form and therefore must be placed one at a time in order to cover the interior surface of the concrete form prior to pouring the concrete.

A different type of retainer is the liner or mat which is used in the horizontal position. These retainers are usually formed from an elastomeric material and have recesses which closely fit the outside of the objects which are to be retained and position these objects in a pleasing serial pattern. The most common of these is the type which is fabricated for holding brick pavers and is designed to have the appearance of a hand formed brick wall. This type of form and retainer is usually arranged in a horizontal position because it lacks a positive device for securely holding the bricks or objects in position.

The more desirable type of retainer for upright construction has a mechanical structure which is attached to the inside surface of the concrete wall form and securely retains the brick or object in proper position before and during the pouring of the concrete. As will be discussed later in the Information Disclosure Statement, these retainers take many different forms and shapes, but none are of the type which can be mass produced and readily disposed of after use. In addition, there is nothing in the prior art which discloses a type of individual retainer which can be used by the home repairman or do-it-yourselfer in such a way that a professional looking wall can be produced.

The applicant in the present invention has discovered a unique way of providing individual object retainers which interconnect with each other and can be securely fastened to the wall of a concrete form and will be automatically positioned to lay out the objects in a desired pattern. This is especially true with brick pavers, whereby the brackets forming the basis of this invention and the brick pavers can be readily installed and secured within the form ready for the pouring of concrete. The individual brackets provided in the present invention are fabricated from readily available materials, such as ABS (acrylic butyl styrene), talc filled polypropylene, expanded polystyrene, and polyurethane, and can be mass produced by injection molding with the necessary interconnecting tabs and slots allowing the bricks to be arranged in many desired patterns.

In another embodiment, the bracket may be produced as a composite, with the bracket base portion made from the above materials injection molded with an elastomeric material as a gasket and retaining cap portion made from a suitable material such as butyl polyvinyl. The elastomer is bonded to the plastic base material and still provides an exterior configuration similar to the solid bracket embodiment.

It is an object of the present invention to provide a lightweight, inexpensive, individual, object supporting bracket which can be easily installed and is disposable after use. A further object is to provide a supporting bracket for attachment to the interior surface of a concrete wall form which can be purchased along with an attached desired object, such as a brick paver, and ready for use.

INFORMATION DISCLOSURE STATEMENT

The following section is provided in order to comply with the applicants' acknowledged duty to inform the Patent and Trademark Office of any pertinent information of which they are aware. The following information refers to the most pertinent patents of which the applicants have knowledge with respect to the subject matter of the present invention. Although other patents may be available which deal with the subject matter, they are believed to be less pertinent than the patents which are discussed herein and therefore will not affect the examination of this application.

The Johnson patent (U.S. Pat. No. 3,594,968) shows a plurality of frames and spacers which are adhesively attached to a wall not a form so as to define spaced openings for the insertion of decorative blocks. The blocks are later positioned within the openings and adhesively secured to the finished wall structure. The present application includes individual brackets or frames for directly holding each individual brick or object and the temporary mounting of a series of frames to the inside surface of a concrete form so that the brick or object will be formed into the surface of the wall when concrete is poured into the forms. The bracket, according to the present invention, is temporary and is removed or released with the form to expose the embedded brick or object.

The Siek patent (U.S. Pat. No. 3,131,514) discloses the construction of a thin precast wall panel. The small plate-shaped elements are fixed on a sheet of paper or a web of fabric by cementing and then inserted into a mold. The mold is used to cast the wall panel with the elements embedded in the exposed surface of the panel. The elements can be bricks. The molding is preformed in the horizontal position.

The Conder et al patent (U.S. Pat. No. 3,231,646) describes the use of an upright form arranged with one side mounted on a trolley and having a plurality of horizontally positioned flanges for supporting and spacing a plurality of bricks vertically along the inside surface of the form. A spring biased hook passes through the form and mechanically holds a brick in position. Clips can also be used to hold the bricks in position with the supporting flanges. This arrangement is far removed from the simple disposable bracket for holding the object as disclosed in the present invention.

The Hicks et al. patent (U.S. Pat. No. 3,496,694) discloses a flexible grid which is bonded directly to decorative members, such as molded brick or other shapes. The prefabricated grid and decorative members are attached to the frame of the building to provide a prefabricated artificial facing for the structure. The difference in this arrangement is that the grid member and the decorative members are attached directly to the surface of the building and remain permanently attached while the present invention is directed to a bracket or frame which holds a brick temporarily in proper position on the inside surface of the wall form during the concrete pouring process for embedding the brick permanently in the surface of the concrete.

The Samuel C. Scott et al. patent (U.S. Pat. No. 5,009,387) discloses a form liner having a plurality of properly positioned recesses for the insertion and retention of brick pavers or other objects. Various retainers are disclosed which hold the objects in proper position against the inside surface of the vertical concrete wall form while the concrete is poured. The form liner is removed with the form and a portion of the retainer, in most cases, remains within the concrete after the form has been removed. Some of the form recesses may include tabs or extensions on opposite sides of the recess to hold the object in position during the concrete pouring process.

The Salazar patent (U.S. Pat. No. 4,644,719) discloses a decorative wall panel which includes a patterned top layer which is formed from a slow-cured molded mixture of Portland Cement, sand and pigmented binder. The opposite ends of the wall panel are adapted to mate and interlock with the ends of similarly constructed panels. The wall panels are made to simulate a traditional brick appearance. FIG. 5 shows a mold which is used for forming the patterned layer. This mold contains a plurality of recesses which are properly placed to simulate brick construction. There is no teaching in this patent of placing the mold on the inside surface of a concrete form and positioning bricks or other objects within the recesses formed in the mold.

The Brouk patent (U.S. Pat. No. 2,825,221) discloses a thin brick embedded panel which is poured in a horizontal form. The bricks are merely positioned within a tray or mold and a thin concrete mixture is then poured over the backs of the bricks to embed the bricks in the surface of the concrete panel. This type of construction is relatively common. It is well known in the art to provide a horizontal form for forming this kind of concrete building panel. The present invention is different in that the bracket which forms the basis of this invention is designed for holding and supporting the individual brick or object against the inside surface of the concrete form. This arrangement allows a novice to be able to position and arrange a plurality of bricks in any desired pattern and obtain a finished product which is comparable to that provided by a skilled craftsman.

The publication, "Ceramic Tile Installation Methods Practiced in Japan", publication date unknown, discloses many different ways of installing tile for exterior decorative finishes. Various methods, such as precast concrete panel methods and fabricated form methods are disclosed in this publication. Many of these methods are those which are already shown and disclosed in various patents which have issued in the United States. It is believed that this publication does not disclose the use of brackets for holding individual bricks or objects within the wall form during the pouring of a concrete wall structure. The brackets provided in the present invention can be disposable and can be removed and trashed when the forms are removed from the original construction. It is also understood that the present brackets can be made from sturdy material and reused many times, if desired.

The Willson patent (U.S. Pat. No. 2,178,535) discloses the use of individual strips of resilient material which are attached to the inside surface of the concrete wall form which is used to hold and support the bricks or objects along the inside surface of the form prior to pouring the concrete. Again, this does not disclose the use of brackets for holding the individual bricks or objects along the surface of a form.

The Porter patent (U.S. Pat. No. 4,947,600) shows a precast concrete wall structure which is provided along the outside surface with a plurality of spaced linear parallel slots. The slots are formed by L-shaped angles which are mounted and attached to the wall and extend the length of a plastic base sheet. Grout is applied over the entire surface of the wall and support/spacer strips are inserted into each of the slots. Pointed tabs which are provided on the strips extend outwardly and support individual bricks which are pushed into and attached to the grout and are held in position by the support spacer strips. Grout or mortar is applied between each of the bricks to simulate a brick wall structure. Individual retaining brackets are not disclosed in this patent.

The Iragorri patent (U.S. Pat. No. 3,602,476) shows an elastomeric template having a plurality of patterned recesses which are formed on the bottom surface of a horizontal mold. Individual bricks are positioned within the recesses and concrete is then poured over the template and bricks. In this way, a brick facing concrete panel for construction purposes is fabricated. The template in this patent is merely included to properly position and space the individual bricks during the pouring process. There is no disclosure in this patent of the use of an individual interconnecting bracket which is the heart of the present invention.

The Weiner patent (U.S. Pat. No. 3,868,801) discloses a building panel composed of masonry objects, such as bricks, synthetic polyester mortar, reinforcing wire mesh and a polymer foam to produce an interfacing layer. This sandwich type construction is held together by the foam mortar. The panel is formed by properly positioning the bricks in the desired arrangement, joining the bricks by applying polyester mortar to the backside of the bricks and between the adjacent bricks, applying reinforcing wire mesh within the mortar and then introducing a foam polymer which is cured in the space between the wire mesh and polyester and the outer facing layer. A composite panel structure is formed which can be mounted on the outer surface of a building or structure. The fabricated product which is disclosed in this patent is intended to be formed horizontally while the present invention can be formed in any angle, and then it is placed with the structure.

The Geisinger patent (U.S. Pat. No. 2,005,030), Pascucci patent (U.S. Pat. No. 3,321,883), Kashiwagi patent (U.S. Pat. No. 4,916,875) and Passeno patent (U.S. Pat. No. 5,311,714) all show various types of brick or tile veneer construction which utilize various types of mass brackets which are attached directly to the outside surface of the building or structure. Various arrangements are shown for attaching the brackets directly to the surface of the structure and these, in turn, retain and hold a multitude of bricks or objects firmly against the outside surface of the structure. The joints between the bricks are filled with mortar or grout to represent masonry construction. None of these patents show individual brackets which are attached to and retain individual bricks or other objects directly to the inside surface of concrete wall forms so that the objects themselves will be embedded in the finished surface of the concrete when the form and bracket are stripped from the form.

The Kelsey patent (U.S. Pat. No. 3,694,533) shows an arrangement for holding bricks or pavers on the inside surface of a concrete form by means of a vacuum retaining system. The vacuum holds the bricks and objects in proper position on the inside surface of the form while concrete is poured and sets to retain the bricks in the surface. Although the vacuum system is removed with the form, there is no disclosure of individual brackets for retaining and holding the bricks in position. The present invention is considerably cheaper and easier to operate than that shown in this prior art. The British patent (491,397) discloses a method of forming and holding objects in a vertical mold. Sand or plastic clay is used to embed and hold the objects in a vertical position while the concrete is poured. Simple and easily used brackets for holding the objects are not disclosed nor is the use of standard concrete forms contemplated.

SUMMARY

The present invention is directed to a simple apparatus and method wherein an individual bracket having a central recessed area is provided which is formed from a suitable metal, wood, plastic, plaster, synthetic resin or frangible type material. The bracket has internal flanges and may include mechanical retaining features in conjunction with the recessed area which are used to temporarily secure an individual brick, brick paver or other object. Various types of adhesives which are suitable for retaining the brick or object in proper relationship to the recessed area of the bracket can be used, if desired, to hold the object in the bracket recess during handling, forming or pouring of a castable material, such as concrete, plaster, plastic, or plastic foam.

The individual bracket is critical to the present invention and is unique from the standpoint that it is arranged to securely hold the brick or object in proper position on the inside surface of the form being used. At the same time, the joint temporarily connecting the bracket and the brick or object is of such a type that when object separation is required it can be easily released from the bracket so that the bracket and form can be quickly removed from the structure when the pouring and setting process is completed.

In the preferred embodiment, the bracket according to the present invention can be formed from a suitable plastic which is frangible or breakable as required. The bracket itself is a thin member having a perimeter outline of the object forming a recess therein. A narrow internal flange is provided around the inside edge of the bracket to act as a surface for supporting, securing and sealing the edge of the object. A suitable adhesive, such as a solvent or water soluble adhesive or a heat releasable adhesive can be used to secure the brick or object to the flange and within the recessed area. The cross section of the perimeter member of the bracket can be curved upward and outward from the object to a flat vertical mating surface which is perpendicular to the face of the object and the flange area. The perimeter member forms one half of a grout line mold in the space between two adjacent objects to produce a concave grout line which is common between the objects. The height of the perimeter mold determines the depth of the finished grout line. A cross member can extend across the central portion of the bracket or the central portion can be closed to provide rigidity and sustain the configuration of the bracket.

When a rake type grout line is desired in the finished structure the cross-section of the bracket can extend upward from the edge of the object recess, to a predetermined height and then turn outward at approximately 90° to meet the flat vertical edge. The height determines the depth of the finished grout line.

If desired, a plurality of detentes can be arranged along the interior surface of the perimeter member or portion of the bracket. The detentes are protrusions or flaps which extend outwardly into the recess and can be made from the same material as the bracket. In some cases, a pair of corresponding protrusions can be provided directly opposite each other across the width or the length dimension of the bracket to provide a corresponding opposed compression retaining force against the object. In other cases, one or more protrusions can be staggered around the inside surface of the bracket in a random pattern. The protrusions or detentes can be used in the brackets with or without the use of an adhesive.

As an alternative, it is also possible that a combination of both adhesive and mechanical retainers, such as detentes or elastic bands, can be used to securely retain and hold the brick or object within the recess either during handling or during the pouring of a settable material, such as concrete.

It has also been found in the preferred embodiment that the interior of the perimeter members of the bracket can be slotted or left substantially hollow to allow the sides of the perimeter members to flex which in turn provides a resilience within the bracket edges to accommodate the various tolerances that exist within commercially available bricks, pavers, blocks, tiles or other objects to be used. This flexure also provides a resilience that creates a sustained compression force on the opposite edges of the object to aid in fixedly and securely holding the object in position.

Another alternative embodiment to the use of detentes to hold the objects within the brackets is to make the brackets a composite of materials and have one part act as a resilient gasket to hold the object in place. The general form of the bracket, with the general outline of the object and any cross member forming the base portion, can be made of rigid materials as described before. The bracket base portion can have a protrusion or ridge standing generally upright from the plane of the object and extending around the perimeter of the bracket. Bonded to the protrusion is a material more elastic than the base material forming a cap portion.

The cross section of the cap or cap portion is shaped to form one half of the grout line interface along the outside perimeter of the bracket with the internal perimeter edge acting as a gasket to secure the edge of the object within the bracket. The cap contour can be one half of the surface of the mold to form the space between two adjacent objects. The cap thus produces the concave or flat grout line.

The elastic material of the cap portion is intended to deform when used. The external surface of the perimeter member will mate with any adjacent bracket perimeter to form the grout line mold in the desired shape. The internal edge of the perimeter cap portion will deform to the shape of the object and physically grip and retain the edge of the object. The internal perimeter edge also serves as a seal to keep the settable material from contacting the exterior face surface of the object held in the bracket. The cross section of the cap portion shows the profile of the exterior of the perimeter to be generally flat and extending upright so as to mate flush and seal with an adjacent bracket. The inner surface of the cap portion can be of any shape desired for the grout line or tool joint configuration, and can be concave, curved, rectangular or triangular as shown in the drawings.

Nesting type tabs and slots are provided along the elongated edges of the bracket base to allow a plurality of brackets to be connected together to either provide a side by side relationship, end to side relationship or a staggered relationship which is common in brick construction. Additional slots are provided on the outer ends of each bracket which allow connection with the side tabs of other brackets. No outwardly extending tabs are provided on the ends to allow the brackets to slide together and be positioned. However, tabs can be provided on the end or ends of the bracket if that arrangement will better fit the attachment arrangement to be used. The idea behind the connection arrangement for the brackets is to allow the brackets to be fastened together in any pattern that is desired to form a grid or assemblage which can be attached by staples, nails, adhesives or any other suitable fastening means to a desired location along the inside surface of a concrete form. The cross section of each side and end member of the bracket forms one half of the mold for the grout line between the bricks. Thus, positioning two (2) brackets together creates a desired concave depression between the bricks forming an aesthetically pleasing simulated brick wall.

Brackets having only partial or half of the standard length can be provided for corners and ends of the brick course making up the surface of the wall. With the additional slots in the ends of the brackets, the brackets can be turned vertically to provide decorative patterns within the brick design forming the surface of the wall. It is also possible that the perimeter configuration of an individual bracket can omit an end and/or side member to leave an open configuration for positioning the bracket at the edge, top or bottom of the form.

Upon removal of the supporting bracket and form from the poured concrete structure, the brackets can be easily removed from the bricks or objects which remain partially embedded in the surface of the wall. Depending upon the type of adhesive, if adhesives are used to hold the object in the bracket, water or solvent can be inserted between the form, bracket and the wall to dissolve the adhesive. If a low heat release adhesive is used, it is possible that the heat generated by the concrete during the curing process could neutralize the adhesive so that the bracket is free from the object when the form is removed. In this way, the entire bracket is removed from the face of the finished wall structure. It is immaterial whether the brackets break or are destroyed at the time of removal since they are primarily intended as an inexpensive, one time use device. In the alternative, the brackets can be made from high strength materials which will allow it to be reused a number of times, whether in the original or a different pattern.

An object of the present invention is to provide a relatively low cost easily handled and installed individual bracket for securely mounting a brick or other object in a desired relationship on the inside surface of a concrete form. With the ease of use of this particular device it is a simple matter for an unskilled person to form, pour and obtain a simulated brick wall without the difficulties and problems which are associated with masonry construction.

The above and other objects, advantages and features of the present invention will become more readily appreciated and understood when taken together with the following detailed description of the preferred embodiment of the present invention in conjunction with the accompanying drawings.

DETAILED DESCRIPTION OF THE INVENTION

Figures 1, 2, 3:
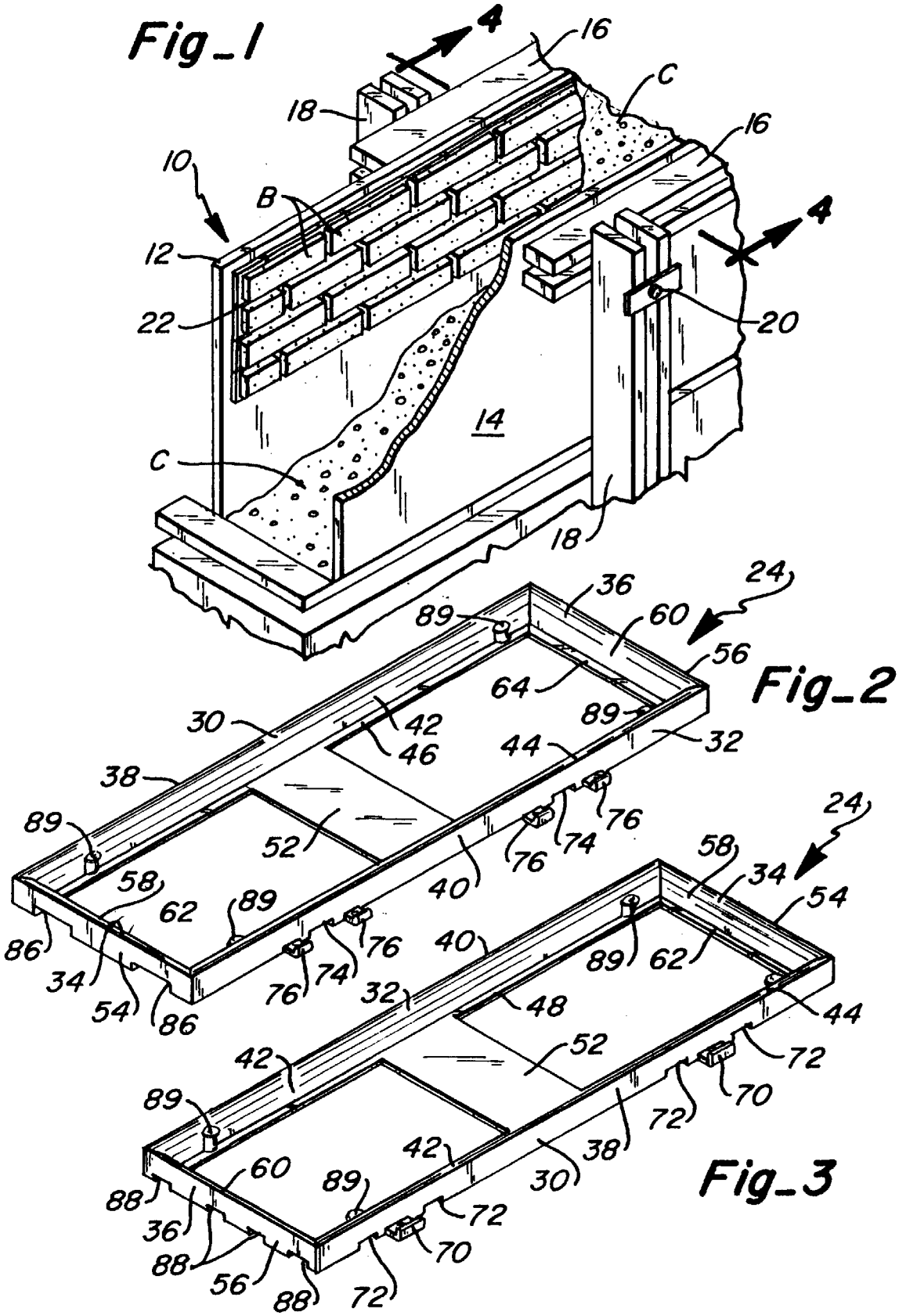
FIG. 1 is a partial cut-away view showing a plurality of retaining brackets and bricks positioned on the inside surface of a concrete form which can be in a vertical, tilted, or horizontal position.
FIG. 2 is a perspective view of an individual bracket according to the present invention.
FIG. 3 is a reverse view of the bracket shown in FIG. 2.

Turning now more specifically to the drawings, FIG. 1 shows a partial cut-away view of a form which is used to construct a concrete wall structure.

As shown in FIG. 1, the brackets can be used in a vertical or upright orientation. It is to be understood, however, that the brackets as described and claimed herein may be used in any form orientation or position such as horizontal, vertical, or tilted.

The vertical form 10 which is used to contain the concrete C while it is setting includes side forms 12, 14, horizontal whalers 16 and vertical ribs 18. Cross-ties 20 are used to hold the vertical side forms 12, 14 at a precise spacing distance to maintain a constant thickness in the finished wall structure.

A plurality of interconnected object retaining brackets or assemblage 22 is suitably secured to the inside surface of the wall form 12. The assemblage 22 is made up of a plurality of individual brackets 24 shown in FIGS. 2 and 3. The individual interconnected brackets securely retain or hold objects, such as brick pavers B, within the brackets. The brackets are provided with tabs and slots so that any design can be formed when the brackets are fastened together in the desired pattern and size. Usually the brackets 24 are arranged to form an assemblage 22 having a convenient size, such as 2 foot by 4 foot, which can corresponds with the dimensions of the inside surface of the form 12.

As illustrated in FIG. 1, the assemblage 22 of brackets 24 is attached to the inside surface of only one side of the form. It is also understood that if objects are to be embedded in both surfaces of the structure then a similar amount of brackets 24 can be assembled and attached to the opposite surface of the form.

The assemblage 22 of individual brackets 24 is attached to the surface of the form 12 usually by staples straddling the two edges of the adjacent brackets 24. It is also feasible to use finishing nails driven through the raised edges of the brackets 24 or as an alternative the brackets can be secured to the surface of the form 12 by means of a suitable adhesive or other attaching device.

Figure 4:
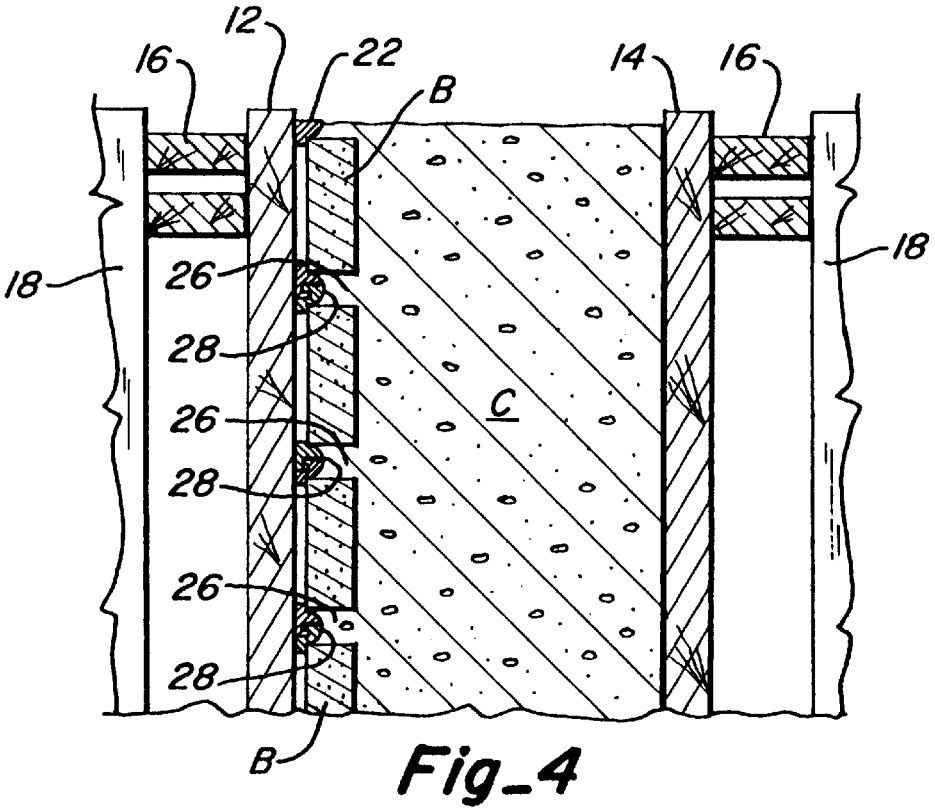
FIG. 4 is a partial cut-away view taken along lines 4—4 of FIG. 1.
Figure 5:
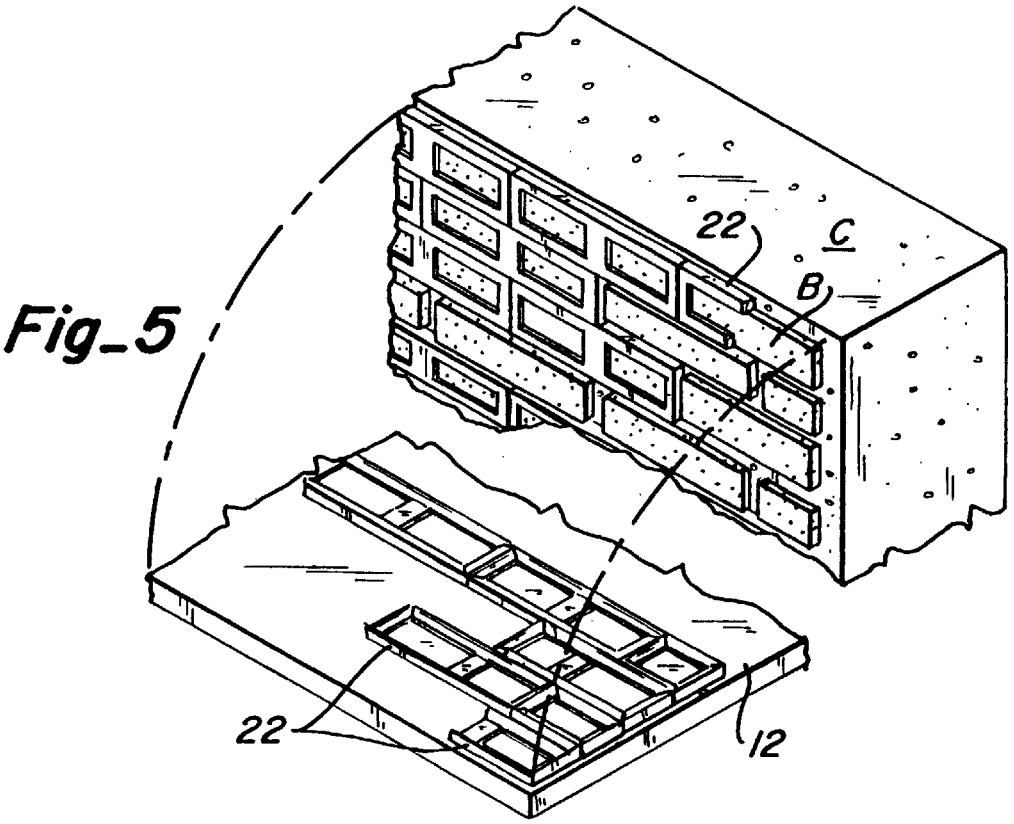
FIG. 5 is a partial perspective view showing the removal of the form from the surface of the concrete structure.

As can be seen in FIGS. 1 and 4, the concrete C is poured within the cavity formed by the outer form 12 and inner form 14. The poured concrete C fills the spaces 26 along the sides of the bricks B. In this way the concrete permanently retains and holds the bricks in the surface of the wall structure. The brackets 24 making up the assemblage 22 can be used in vertical wall construction, but it is also understood that the same devices can be used in horizontal or tilt-up construction, if desired. The main advantage of the present invention is the fact that the objects can be custom arranged as desired and securely retained and held against the inside surface of the concrete form during wall construction or against the inside surface of a concrete form at any angle. This is a secure and reliable way of retaining the objects in proper position and secured against the surface of the form during the pouring of the concrete.

The curved top surfaces of the perimeter members of the brackets 24 when assembled act as a template or mold and create a concave surface 28 in the finished concrete filling the space 26 between the adjacent objects. This provides a concave grout line appearance between the objects which provides a natural masonry construction appearance. As a design choice, if a rake joint is desired, the top surface of the perimeter members 148 will be formed flat, thus forming a rectangular molded grout line surface (see FIGS. 14–15). Other grout line configurations can be chosen with an appropriate change in the cross-section of the perimeter surface.

Once the concrete C has properly set, the form support framework including whalers 16, vertical ribs 18, and vertical forms 12, 14 are removed from the concrete structure. In this way, the surface of the concrete containing the embedded bricks or objects is exposed. In many cases, the assemblage 22 will strip away from the brick facing and remain attached to the outer form 12. However, in some cases the individual brackets 24 will break apart possibly leaving some portions attached to the brick and concrete material. Depending upon the type of adhesive which is used to secure the brick B to the surface of the bracket 24, such as water or solvent soluble or heat affected adhesives, it is a simple matter to either wash the outer surface of the structure to dissolve the remaining adhesive or to use a hot water spray which will melt and/or dissolve the adhesive if it is a temperature melt type. In any case, the brackets are striped from the face of the concrete structure leaving a simulated masonry surface with the bricks relatively clean or requiring only a minimal amount of additional washing. In this way, the labor costs can be greatly reduced due to the reduced cleaning requirements.

For the sake of illustration, the individual bracket 24 which will be described herein is sized and intended for retaining a brick paver. As is commonly known, a brick paver is an object having the side dimensions of a standard brick but is only approximately one half to five eighths of an inch thick. It is primarily intended for use in lining walkways and is used like a tile in construction. It provides a simulated brick facing similar to masonry construction when embedded in the surface of concrete walls. The material which is used to fabricate the brick paver is the standard fired clay masonry material.

As shown in FIGS. 2 and 3, the retainer bracket 24 is composed of side perimeter members 30, 32 and end perimeter members 34, 36. The difference in the views shown in FIG. 2 and 3 is that the bracket in FIG. 3 is reversed 180° from the position shown in FIG. 2.

The outside surfaces 38, 40, respectively, of the side members 30, 32 are flat while the inside surfaces 42,44, respectively, of the side members 30, 32 are curved to form a concave cross-section from the flat outer surfaces 38, 40 to a narrow flange surface 46, 48. For those alternatives of a V-tool joint, a square rake joint, or any other joint shape, the corresponding mold shape is made by the selection of the shape of the perimeter top surface. The outside surface 38 of the side member 30 and curved front surface 42 have relatively constant thickness forming a cavity or slot 48 within the side member 30. Although it is possible to make the side member 30 a solid piece, it is desirable to include the cavity 48 in the construction to provide resilience and flexure between the outer surface 38 and curved inner surface 42. This flexure can accommodate variations in the outer dimensions of the brick pavers which can vary substantially due to the tolerances allowed for this type of product.

The flange surfaces 46, 48 can be connected by a cross-member 52 which adds rigidity to the overall bracket structure 24. The overall basic structure of the side member 32 is identical to the side member 30. By the same token the end members 34, 36 also have the same cross-section configuration which is formed by outer surfaces 54, 56 and inner curved surfaces 58, 60. Flange surfaces 62, 64, respectively, are also provided and are substantially perpendicular to the outer flat surfaces of the member.

The outer surface 38 of side member 30 includes a pair of outwardly extending tabs 70 which are each flanked on both sides by a pair of slots 72. In the same way, the outer surface 40 of side member 32 includes a pair of relatively wide slots 74 which are each flanked on both sides by outwardly extending tabs 76. The tab 70 includes a sloped face 78 and a raised ridge or catch 80. The spacing between the raised ridge 80 and the flat surface 38 of the side member 30 is arranged to accommodate the thickness of the associated side surface of the mating bracket. In the same way, each of the tabs 76 include a slanted outer surface 82 and a raised ridge 84. The sloped faces 82 and 78 are provided to accommodate the snapping together and connection of the bracket members 24.

Figure 6:
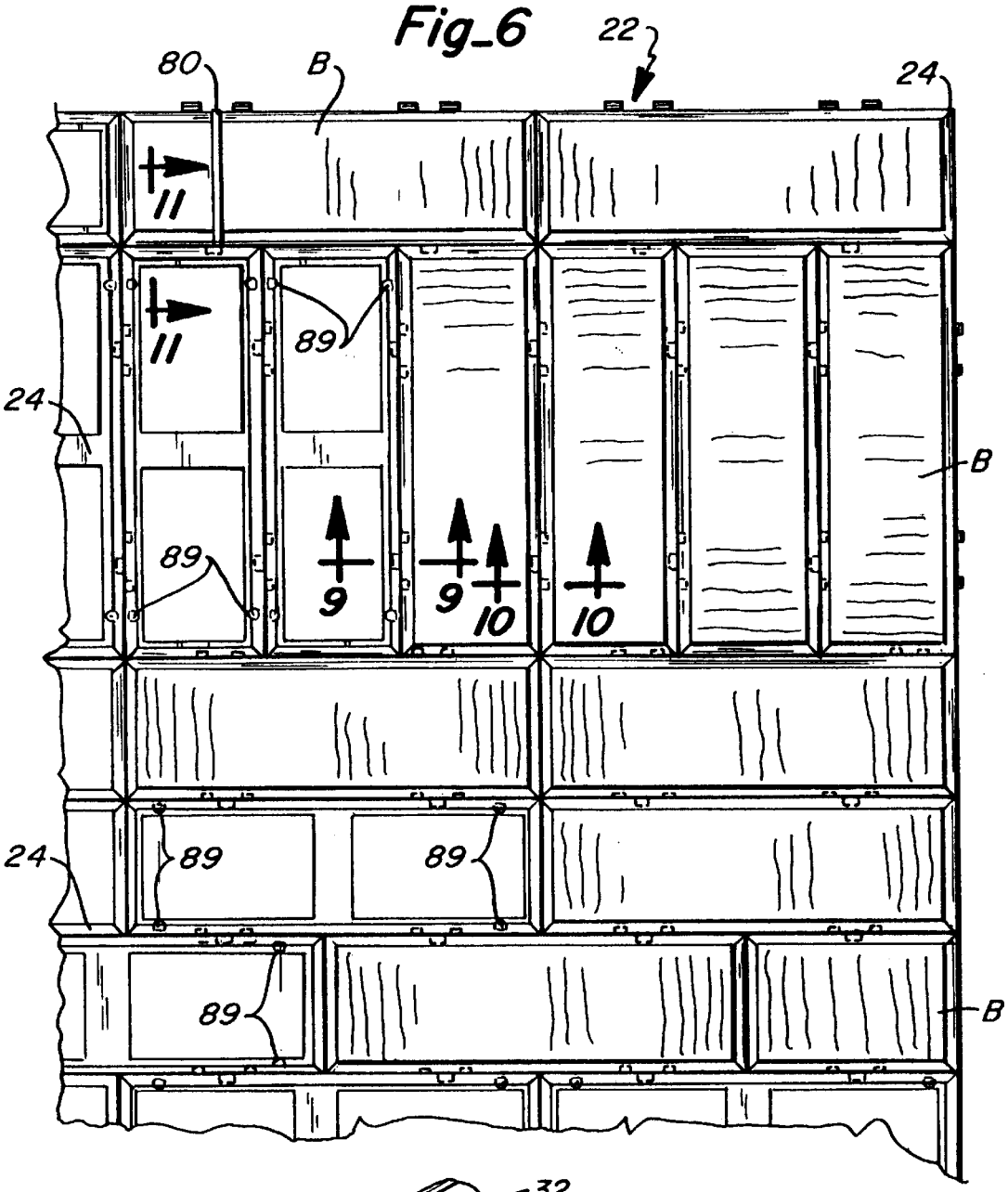
FIG. 6 is a partial elevation view showing the positioning of a plurality of retainer brackets and bricks showing a distinct pattern design that is capable with the present invention.
Figure 7:
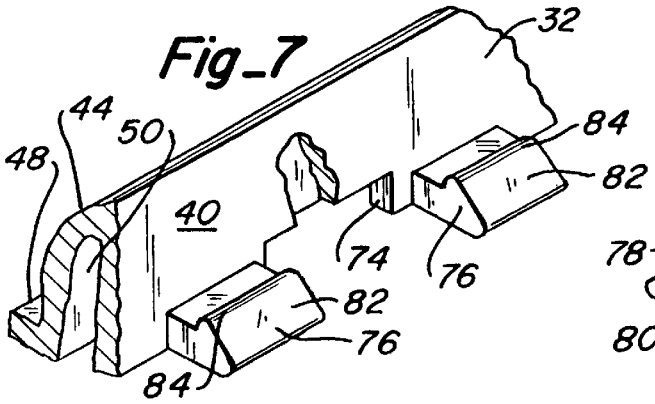
FIG. 7 is a partial cross-section view of one edge of a retainer bracket.
Figure 8:
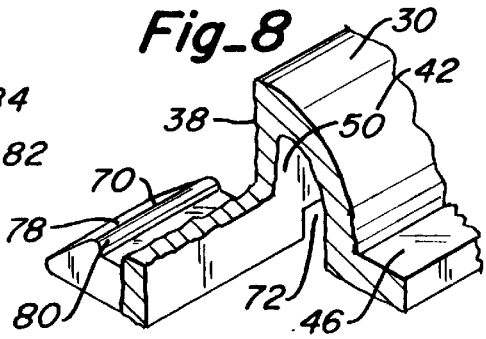
FIG. 8 is a partial cross-section view of the opposite side of the retaining bracket edge shown in FIG. 7.

As can be easily seen in FIGS. 2 and 3, the slot 74 provided in the outer surface 40 of the side member 32 is sized to fit the outwardly extending tab 70 provided on the outer surface 38 of the side member 30. Thus, the tab 70 will easily slide into the slot 74. In the same way, the pair of outwardly extending tabs 76 on the outer surface 40 of the side member 32 are spacedly positioned to mate with the position of the slots 72 provided in the outer surface 38 of the side member 30. To simulate standard masonry type construction usually the adjacent brackets 24 will be staggered so that half of one bracket is in juxtaposition to half of the adjacent bracket. Thus, one of the tabs 70 and a pair of slots 72 will connect with one slot 74 and pair of tabs 76 on the adjacent bracket. This is illustrated in the lower portion of FIG. 6.

The end member 34 includes a pair of slots 86 which are sized and positioned to accommodate the tabs 70 on flat surface 38 of side member 30. In a similar fashion the flat surface 56 on end member 36 includes two pairs of slots 88 which are sized and spaced to accommodate the tabs 76 on the flat side surface 40 of side member 32. These slots are provided to accommodate the outwardly extending tabs on the side members when the brackets are set with an end adjacent the sides of other brackets for a decorative pattern change as shown in the upper portion of FIG. 6. Normally no outwardly extending tabs will be provided on the outer surfaces of the end members 34, 36. It is obvious that if tabs were provided then the ends could not slide together when the sides of the brackets are interconnected. It is to be understood, however, that tabs could be added to the end members 34, 36, if an accommodation is made in the adjoining bracket to allow the tab to slide into place during the interconnection of the side members.

It should also be considered that the width and height of the slots 74 and 72 provided in the side members of the bracket are sized and positioned to accommodate the adjoining tabs whether they be the tab pairs 76 or the single tab 70. Also, the positions of the tabs and their associated slots along the side of the brackets are arranged so that they are centered along each half of the bracket side members. In this way, the brackets can be symmetrical when they are connected or turned to form various brick patterns in the finished product.

It is further understood that any type of connector arrangement can be provided along the sides and ends of the brackets which will provide an interfit and connection to hold the individual brackets in proper position when forming the assemblage or patterns as desired.

It is also to be understood that all connectors can be omitted from the outside mating surface of the bracket and the brackets can be positioned adjacent to each other and held or attached to the form by any satisfactory fastening arrangement.

Figure 9:
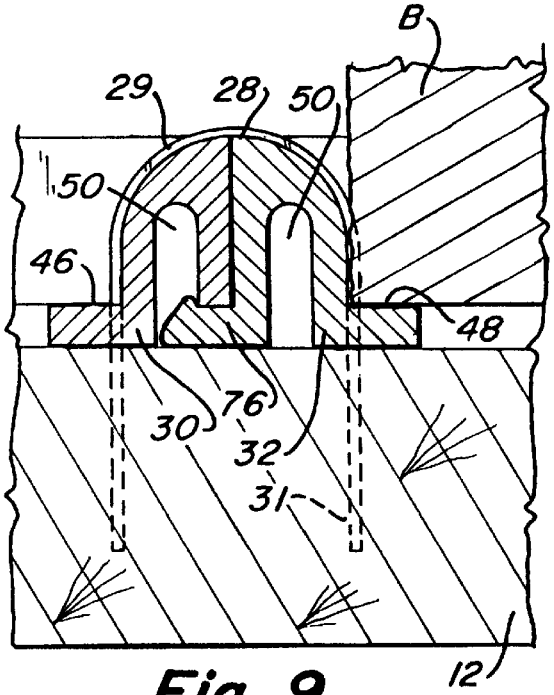
FIG. 9 is a partial cross-section view showing the joint between brackets taken along the lines 9—9 of FIG. 6.
Figure 10:
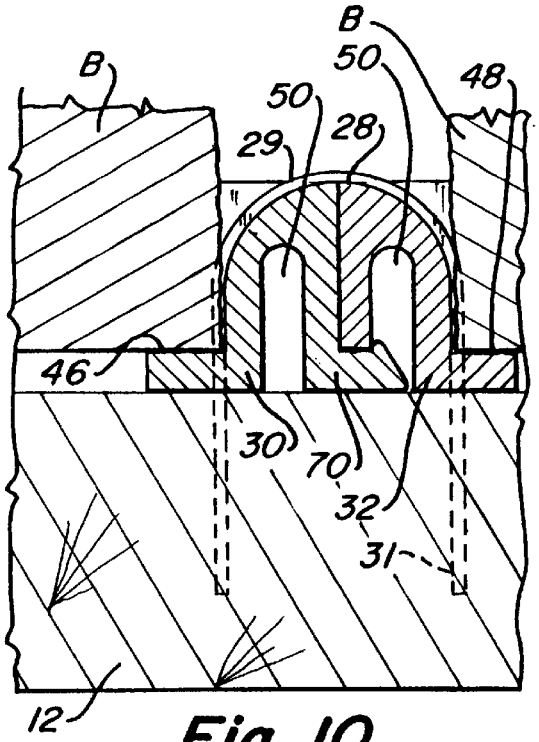
FIG. 10 is a partial cross-section view taken along the lines 10—10 of FIG. 6.
Figure 11:
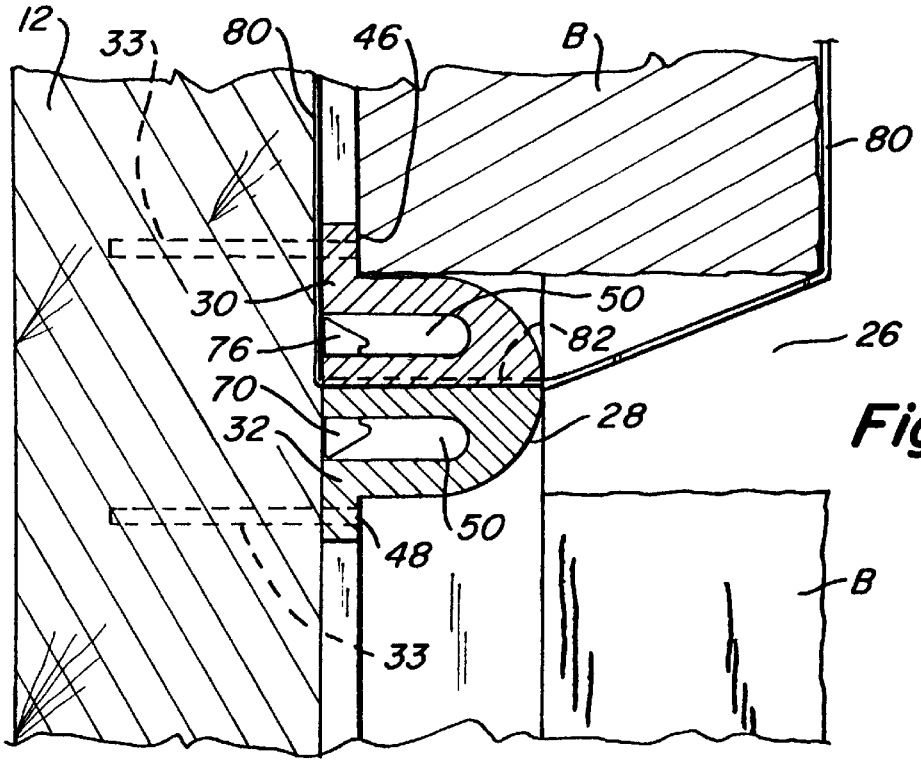
FIG. 11 is a cross-section view taken along the lines 11—11 of FIG. 6 showing the brick removed from the lower recess.

As seen in FIGS. 9, 10 and 11, when the brackets are joined together side by side to form the assemblage 22, the cross-section of the side perimeter members of the two adjacent brackets form a curved ridge 28 between the individual brick pavers. This ridge, as mentioned above, forms a concave grout line in the space 26 between the brick pavers in the finished wall structure. The height of this ridge can be varied to adjust the depth of the grout line in the finished structure.

Protrusions or detentes 89 can be formed along the inside surface of the curved perimeter members. These detentes can be flaps or knobs extending inwardly from the side or end members so that they will contact the opposing side edges of the object. Any number of opposing detentes 89 can be used along the perimeter members to hold and retain the object in the recess. The detentes can be formed as an integral part of the perimeter members of the bracket or can be formed from a separate material and suitably fastened into proper position. The purpose of the detentes is to provide a compression force on opposite sides of the object to securely hold it in place. These mechanical retainers can be provided separately or in combination with adhesives or any other retainer device.

Figure 12:
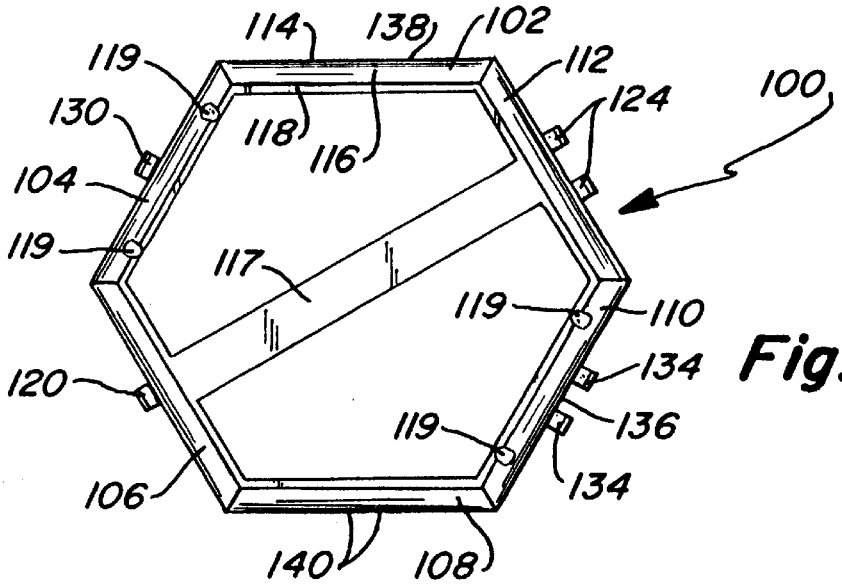
FIG. 12 is a plan view of another embodiment of the retainer bracket according to the present invention showing a hexagon shape.
Figure 13:
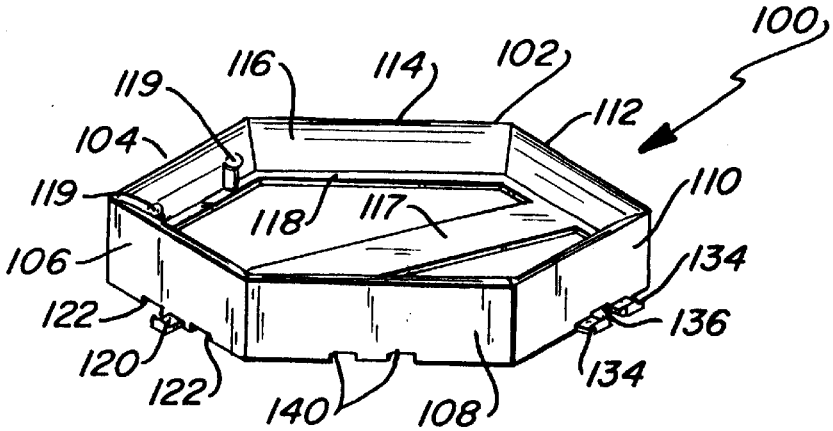
FIG. 13 shows a perspective view of the bracket shown in FIG. 12.

FIGS. 12 and 13 show another embodiment of the object retaining bracket which has been shown and described above. In this configuration the bracket is designed for retaining and supporting a hexagonal tile. Of course, it is to be understood that the object shape can be of any desired configuration so long as the outer perimeter of the bracket itself can be substantially symmetrical. This symmetry is desired, but is not mandatory, in order to allow the brackets to be interconnected into a desired assemblage.

The bracket 100, includes outer side perimeter members 102, 104, 106, 108, 110 and 112. The cross-section of these side perimeter members is essentially the same as those provided and discussed earlier for bracket 24. The side member 102 includes a flat perpendicular outer surface 114 and curved front surface 116. Each of the other side members have a similar surface configuration. The side member 102 also includes an inwardly extending narrow flange or ledge 118 which is used to support and secure the retained object. The width of the flange 118 is sufficient to adequately support and secure the object. This also provides a seal to prevent the concrete and grout mixture from flowing past the curved surface 116 on the side of the object and onto the finished face of the retained object. It is also to be considered that instead of the flange being narrow it can extend partially or completely across the recess portion of the bracket so as to close the central portion of the bracket.

A plurality of detentes or protrusions 119 can be formed on the perimeter members so as to extend into the recess and contact the side of the object. These detentes 119 function the same as described in the earlier embodiment. They can be used in pairs diametrically opposed across the bracket. As an alternative, the plurality of detentes need not be diametrically opposed across the bracket but rather, placed according to the retention needs of the object and its application.

As can be seen in both FIGS. 12 and 13, the same configuration is provided as stated above for each of the side members. It is anticipated that, in most cases, there will be an even number of side members to coincide with the outer shape and dimensions of the anticipated retained object. The desirability for the even number of sides is to facilitate the connection of the brackets to form the assemblage. On the other hand, an odd number of side members is possible.

In the six sided hexagonal figure which is shown in FIG. 12, two opposite side members, such as 106, 112 have an interconnecting tab and slot arrangement similar to those which were previously described. Thus, side member 106 along the outer surface includes an outwardly extending tab having an upwardly raised ridge along the outside edge and two equally spaced slots 122. On the opposite member 112 are a pair of outwardly extending tabs 124 also having an upwardly extending ridge along the outer edge of the tabs 124 and between these tabs is positioned a slot which is sized to fit the tab 120 on the opposite number. By the same token, slots 122 are sized to fit the pair of tabs 124 positioned on the opposite side member. Thus, the side member 106 on an adjacent bracket 100 can be positioned next to the side member 112 of the presently described bracket which will interfit and connect together forming the curved upwardly extending ridge for forming the concave grout line in the finished product as previously described. In the same fashion, the side member 104 has a single outwardly extending tab 130 and slots 132 positioned on either side of the tab 130. The opposite side member 110 includes the double outwardly extending tabs 134 and the slot 136 positioned there between.

The remaining two side members 102, 108 do not have any outwardly extending tabs, but do provide accommodating slots 138, 140 which are sized, positioned and arranged to correspond and interfit with a single or double outwardly extending tab arrangement provided on the other side members. This allows these blank side members to receive the tabs from the adjacent positioning of the other brackets within the assemblage. Throughout this description it is understood that any number of side members can be provided where the arrangement is symmetrical so that the brackets will fit together in a close connected assemblage. By the same token, all slots and tabs can be omitted if it is desired to merely position the individual brackets against each other when installing on the inside surface of the form.

This interconnection or positioning of the brackets provides the pattern of the tiles, objects or bricks in the surface of the finished concrete structure. It is also understood that spaces can be left between the individual brackets. Thus, the objects can be positioned randomly across the surface of the structure.

A cross-member or tie 117 can be provided to interconnect the flange members on two opposite side perimeter members in order to hold the shape of the bracket relatively rigid. There is enough flexure, however, in the overall structure to allow the bracket to accommodate various sized objects to account for the tolerances which are normally encountered in the manufacture of the objects. This is to say that if the object is slightly larger than standard, the bracket will expand slightly to accommodate a reasonable oversized dimension for the object.

It is also understood that the retaining bracket which is the subject of this application can have a single perimeter member which can be curved to form a closed or partial circular or elliptical configuration. The configuration of the perimeter member and thus, the bracket conforms to the intended object. Whether the member is closed or only partial is determined by the object and the contact retention required for this particular object.

Figure 16:
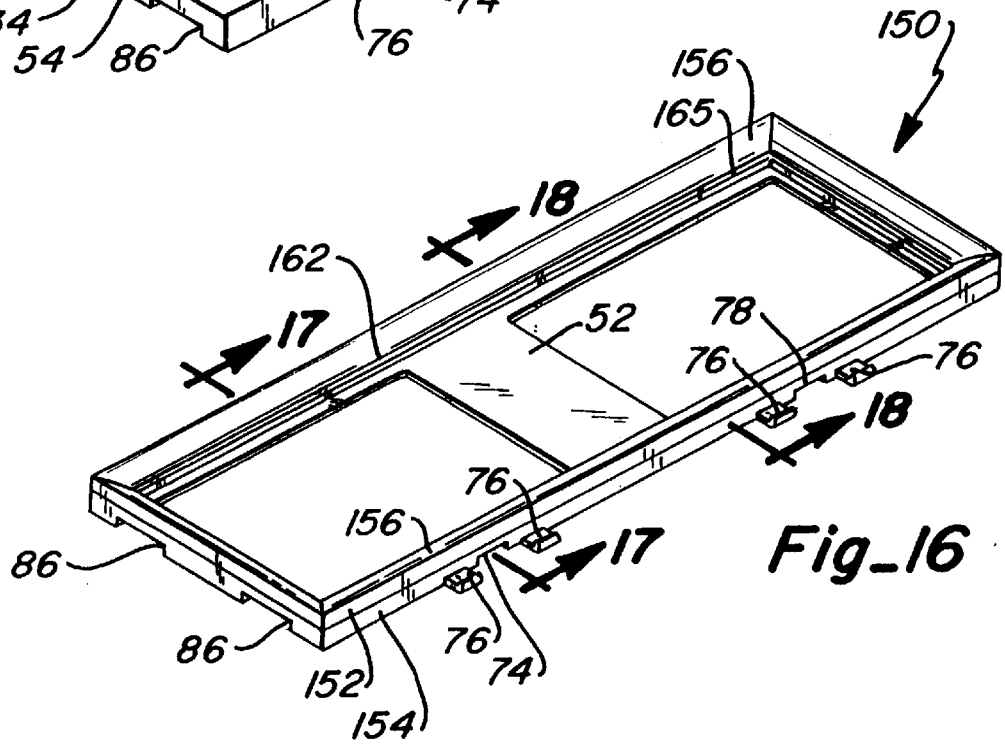
FIG. 16 is a perspective view of another embodiment of the bracket made from a relatively rigid base portion and an elastomeric cap portion.
Figure 17:
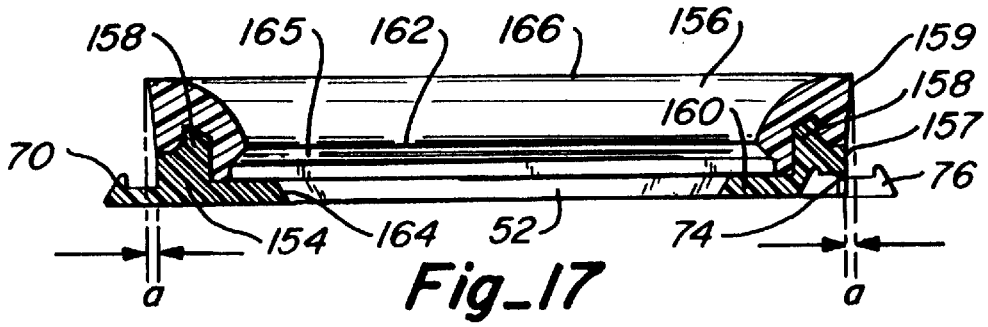
FIG. 17 is a cross-section through lines 17—17 of FIG. 16 showing the composite structure.
Figure 18:
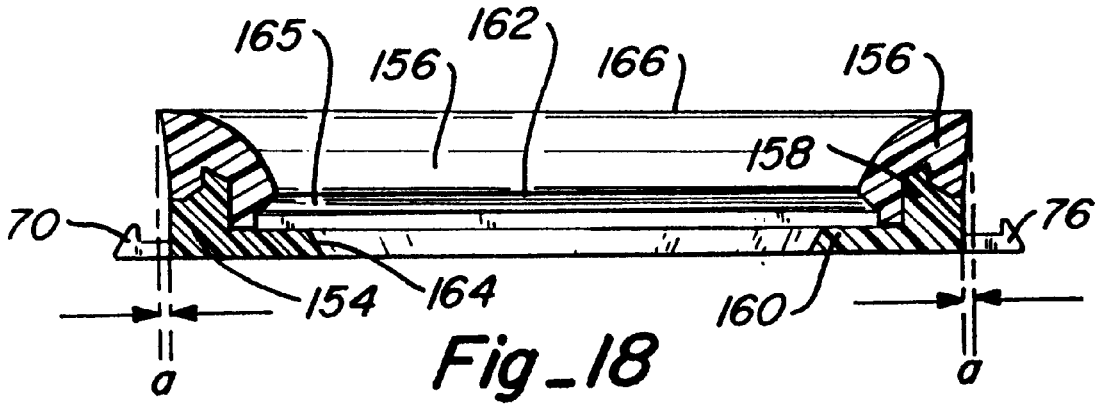
FIG. 18 is a cross-section through lines 18—18 of FIG. 16 showing the composite structure near the mid portion of the bracket.

FIGS. 16–18 illustrate an embodiment of a composite bracket 152, having a base portion 154 and a top perimeter cap portion 156. The base or base portion can be fabricated from a rigid plastic material the same as or similar to the materials described above in the solid material bracket. The cap portion can be fabricated from a resilient elastomeric type polymeric material, such as polyethylene resins, polyproplyene resins or polyurethane resins. The latter resin has been found to work quite well for the intended purpose. The bracket itself is formed with the base portion 154 having a flange area 160 and a ridge or key 158. The key 158 can have an upstanding ridge or series of knobs to facilitate the molding and bonding of the resilient material making up the cap portion 156. An outer flat mating surface 157 is included as part of the base portion 154 and provides a rigid contact surface for contact between the adjacent brackets. The upper portion or cap portion 156 is formed or molded from a resilient, elastomeric polymeric material which has some flexibility but is also somewhat rigid. This material is molded as a cap forming the perimeter edge similar to the surfaces shown for the bracket 24 in FIGS. 2 and 3. However, instead of having a flowing curved surface extending upwardly from the interior flange areas to the outer edge, the elastomeric material 156 forming the top cap or portion has a flowing rounded surface 155 extending from the outer edge 166 to an inner ridge 162 and then being formed as an undercut returning to the flanged surfaces 160. The reason for the undercut portion is to allow the ridge 162 to extend inwardly toward the recess to form a retaining ridge and seal for securely holding and retaining the object. The knob or key 158 extends above the elevation of the ridge 162 to provide a rigid support behind the ridge area 162. The knob 158 also can have undercut surfaces to facilitate the bonding and retention of the top cap portion 156 to the bottom portion 154. It is also to be understood that any type of ridge surface configuration can be provided in this general area to provide the retaining force for sealing and holding the object within the bracket.

In addition, it is also possible to have a ridge that is only intermittent around the perimeter of the bracket in equal or random lengths to provide the retaining function. A surface treatment can be provided on the outer surface of the ridge area to enhance the gripping and retaining power of the bracket. This surface treatment can be, such as a serrated edge, a multiple groove arrangement extending parallel around the perimeter of the top portion or the outer edge surface of the ridge portion can be of a different material having a different Shore A hardness number. This could be a difference in the primary material or could be a separate insert imbedded in the surface of the cap portion.

Figure 19:
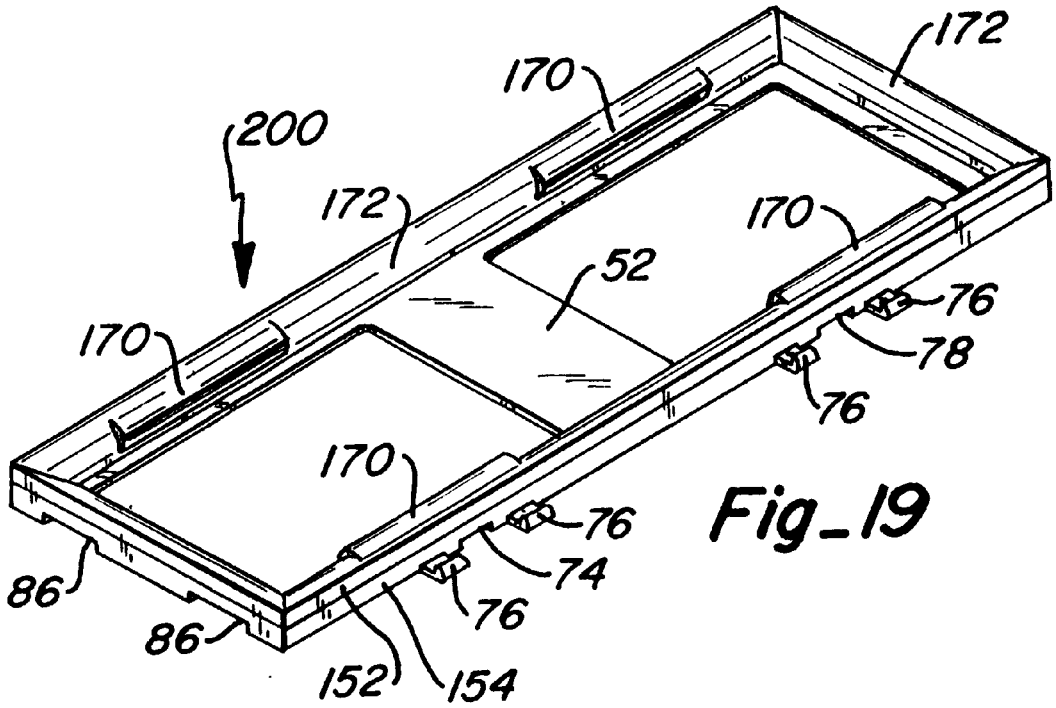
FIG. 19 is a persepective view showing ridge sections in the elastomeric cap portion of this embodiment.

The outer surface 159 of the cap portion 154 can be molded so that the top edge 166 extends slightly outward from the flat surface 157 of the base portion 154. The purpose of this outer extension of the upper portion of the cap portion is to allow the surface 159 to abut against an adjacent bracket, causing the two surfaces to slightly compress forming a seal between the surfaces of the resilient materials of the brackets. This outward extension is shown as Dimension a in FIG. 17. Dimension a can actually vary from 0 to 0.125 inches or more, depending upon the amount of compression desired for sealing purposes. Through experimentation, it is found that just 0.005 inch is sufficient to provide a relatively adequate seal. FIGS. 17 and 18 show a cross-section of the composite bracket made up of the base portion 154 and the top cap portion 152. The difference between these figures is the cross-section of the tabs and slots which have been disclosed as one way of providing the connectors for attaching the brackets together in any design or assemblage. FIG. 19 reveals an embodiment of the disclosed composite bracket having intermittent sections of the ridge portion 170 extending inwardly from a curved surface 172 which provides the molded concave grout line along with the ridge sections 170. This embodiment is provided to illustrate the various modifications which can be applied to the bracket and the perimeter surface and still be considered part of the present invention.

Figure 15:
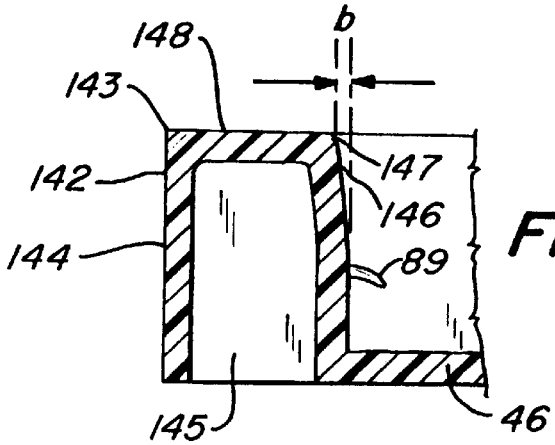
FIG. 15 is a cross-section taken along the lines 15—15 of FIG. 14 showing the rectangular configuration to form a rake type grout line.
Figure 14:
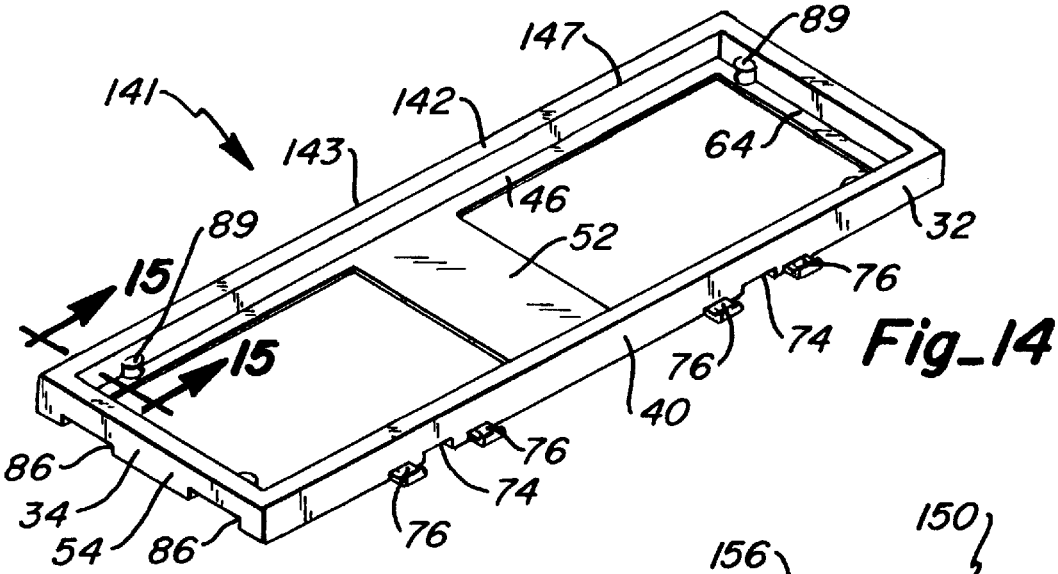
FIG. 14 is a partial cross-section view of a bracket having a rectangular perimeter member and detentes positioned randomly along the inside edge of the perimeter member of the bracket.

FIG. 14 shows another embodiment of the bracket 24 which is illustrated in FIGS. 2 and 3. The bracket 141 has a modified perimeter cross-section which produces a so called rake grout line in the finished wall surface. The rake grout line is one that has a generally flat surface recessed below the outer surface of the bricks or objects. FIG. 15 is a general cross-section of the perimeter of the bracket 141 showing the outer flat surface 144 joining in a sharp corner edge 143 to a relatively right angled top surface 148. The top surface 148 is joined in either a sharp or curved edge 147 blending into a slightly curved and downward surface 146 which joins to the flange 46. For the purpose of flexure between the wall surfaces 146 and 144 a void 145 can be provided between these surfaces in order to provide flexure in the bracket perimeter to be able to slightly adjust to the variance in the dimensions of the brick or objects due to the tolerances of manufacturing these items. The surface 146 can taper outwardly to provide a slight bevel, having a width of Dimension b to provide clearance between the surface 146 and the object. This tapering of the surface 146 permits easy removal of the bracket from the embedded object when the bracket and form is removed. Additional tensioning can be provided by detentes 89 which can be positioned either in opposing pairs or randomly around the inside surface of the perimeter in order to contact the object and to assist in retaining the object within the bracket 141. The taper on the surface 146 can be as little as five thousandths of an inch up to any dimension which is desired and still provide the desired profile and form for the grout line to be produced in the finished structure.

Again, it is to be noted that any of the disclosed brackets can be arranged to have any number of sides and perimeter shape which is required for fitting the desired object and purpose. This invention is not to be limited in any way by the overall shape, size or configuration of the object.

In using the composite bracket 150, it is believed that the necessity for using extra devices for securing the object in the bracket will be unnecessary. No additional finish for coating, such as a wax coating, will be required on the face of the brick or object. A retarder paper can be cut to follow the interior dimensions of the recess and this paper may be inserted in the bottom portion of the bracket before the insertion of the object. In this way, as a backup, the retarder paper will keep the surface of the object uncontaminated and easly cleaned, even if a small amount of leakage of the grout from the concrete actually seeps past the retaining elastomeric ridge.

Throughout the discussion of the object retaining brackets that has been disclosed in this application, a critical area is the attachment of the object, such as the brick paver or tile, to the bracket so that it is rigidly secured to the bracket until such time as the bracket is intended to be stripped away from the embedded object retained within the surface of the concrete structure. One method which can be used with the single material bracket is an adhesive for securely attaching the object to the flange portion of the bracket and to seal the perimeter edge of the object to the bracket to prevent leakage of concrete between the bracket and the finished face of the object. For the composite material brackets, the resilient cap portion forms a gasket like seal around the outside edge of the object. This gasket then performs the dual purpose of holding the object in place and sealing the perimeter edge of the object preventing leakage of the concrete onto the finished face of the object.

It is the intent of the inventors to use an adhesive or device that will allow the bracket to be subsequently released from the face of the object when the form is stripped. The adhesive can be in the form of a water soluble glue, such as an organic vegetable adhesive or a suitable wax type adhesive having a paraffin base. With a water soluble type glue or adhesive, when it is time for the form to be stripped from the surface of the concrete, spraying water between the form and the finished concrete face will loosen the retention of the bracket to the object and allow the form to be easily stripped from the structure. It has been found that "Dextrine" liquid adhesive manufactured by H.B. Fuller Company is a suitable adhesive for this purpose. In the same way, a hot water or hot air stream can be applied where the adhesive is a paraffin base type wax. In this arrangement, the wax will melt from the increased temperature allowing the form to be removed.

It is also possible to provide other types of adhesives, such as those which can be softened by solvents or a type of adhesive that has a relatively low retention rate that can be pulled away from the finished surface by applying sufficient breakaway force.

It is also possible to use an elastic retainer, similar to an elastic band or "rubber band" 80 which is shown in FIG. 11, to either retain the object in position on the bracket or to aid in the retention of the object. This is to say that the elastic band can be used by itself or can be used in conjunction with the adhesive or other retainers for retaining the object. It is possible that a narrow, shallow slot 82 can be provided along the outside flat surfaces of the side members 30, 34 of the bracket 24 to accommodate an elastic band 80, if desired. It has also been found through experimentation that a slot may not be necessary since the elastic band 80 can be squeezed between the surfaces of the brackets. In this configuration, when the form and brackets are removed from the surface of the finished structure, the elastic bands will readily separate and retract into the surface of the finished concrete making them virtually invisible.

The brackets themselves can be fabricated from any suitable material, such as polypropylene, polyvinyl chloride (PVC) or high impact polystyrene. "HIP", high impact polystyrene, from Monsanto Chemical Corporation has been found to be quite suitable for this type of structure. In the composite bracket, the base portion can be made from the same material as listed above. The cap portion can be fabricated from a resilient, elastomeric synthetic polymeric material, such as polyethylene resins, polypropylene resins or polyurethane resins. The latter has been found to work quite well for this purpose. The selected material needs to be pliable but yet rigid to retain the object and provide a seal when required. A material having a Shore A hardness from 10–50 will be satisfactory.

It is also to be understood throughout this application that the object retainer bracket as described herein can also be used in the forming of structures utilizing other types of settable medium, such as plaster or various types of settable plastics. The purpose of the individual bracket provided in the present invention is to allow an individual object along with any number of additional objects to be securely retained in a form to hold or retain the object while the construction medium is poured into the form or cast and which will allow the object to be firmly embedded in the surface of the finished structure or product.

Throughout this application the cross-section of the perimeter members of the retaining bracket has been illustrated and described as being an upwardly and outwardly curved surface so that when joined together with an adjacent bracket a grout line will be formed in the finished surface having a smooth concave surface. It is intended that this is a best mode disclosure but that the invention is not limited to this configuration. The cross-section of the perimeter members of the bracket holder can have any configuration desired, such as rectangular, square, diamond shaped, oval, etc. The shape and dimensions of the cross-section of the perimeter member of the retaining bracket which extends from the flange area to the mating surface of the edge forms one half of a mold which establishes the width, depth and shape of the grout line between the objects.

While an improved object retaining bracket for use in a construction form has been shown and described in detail in this application, it is to be understood that this invention is not to be limited to the exact form disclosed and changes in detail and construction of the various embodiments of the invention may be made without departing from the spirit thereof.

What is claimed is:

1. A bracket for retaining a brick paver having a relatively flat face surface, including an outer perimeter edge in position adjacent to the inside surface of a concrete form whereby the brick paver will be embedded in the surface of the finished concrete structure with the face surface of the brick paver exposed, said bracket comprising:

a. a pair of opposed side perimeter members and a pair of opposed end perimeter members joined end to end to form a rectangular configuration surrounding a recess area, said recess area being sized to fit the outer perimeter edge of the face surface of said brick paver;

b. said side and end members having a cross-section which includes a flange area which extends inwardly into the recess area from the side and end perimeter members to support the brick paver position therein;

c. each side and end perimeter member includes an extended surface which extends from said flange area to an outer mating surface which is generally perpendicular to a plane through the support surface of the flange area whereby the cross-section of said side and end perimeter members forms one half of a grout line mold for forming the concrete between two brick pavers supported by their adjacent brackets; and d. said bracket is a composite of at least two different materials, each of said perimeter members includes a base portion and a cap portions, the base portion is formed from a substantially rigid material and has a cross-section having a flanged area for contacting the perimeter edge of the face surface of the brick paver and an outer mating surface extending substantially upright from a plane through the flanged area for contacting adjacent brackets, the cap portion being formed from a flexible, resilient material which is secured to said base portion, said cap portion having an outer mating surface which is an extension of the mating surface of the base portion and an extended surface extending from the flange area to the edge of said outer mating surface whereby the cross-section of the perimeter member forms one-half of a mold so that in conjunction with and adjacent bracket a grout line will be formed in the finished structure between adjacent embedded brick pavers.

2. A retaining bracket as defined in claim 1 wherein the mating surface of the cap portion of a perimeter member is angled outward from the mating surface of the base portion to form a compression seal with an adjacent bracket.

3. A retaining bracket as defined in claim 1 wherein the mating surface of the base portion is flat.

4. A retaining bracket as defined in claim 1 wherein the extended surface of the cap portion of at least one perimeter member has an elongated ridge extending inward toward the recess area to contact the object and form a means for retaining the object within the bracket.

5. A retaining bracket as defined in claim 4 wherein the cap portion of all perimeter members has a continuous ridge extending around the inside perimeter of the members for retaining the object to the bracket.

6. A bracket for retaining an object having a face surface in proper position on the inside surface of a form for a structure while a settable material is poured into the form to harden and embed the object with the face surface exposed in the surface of the finished structure, the face surface of said object having a perimeter edge configuration, the bracket comprising:

a) one or more perimeter members;

b) said perimeter members being arranged in a continuous series to conform to the outer configuration of the perimeter edge of the face surface of the object and to form a recess there between for receiving said object, the cross-section of said perimeter members having a flanged area for contacting and supporting the perimeter edge of the face surface of the object and an extended surface which extends from the flanged area and joins a mating surface along the outer edge of said members;

c) the extended surface being a mold shaped to form a joint line in the settable material between two objects when their corresponding brackets are positioned adjacent to each other; and d) one or more of t he perimeter members includes a base portion and a cap portion, the base portion is formed from a substantially rigid material and has a cross-section having a flanged area for contacting and supporting the perimeter edge of the face surface of the object and a partial mating surface which extends upright from a plane through the flange area, the cap portion being formed from a flexible, resilient material which is bonded to said base portion, the cross-section of the cap portion has a mating surface which is a continuation of the mating surface of the base portion and an extended surface which extends from the flange to an edge of the mating surface of the cap portion which forms a mold for forming a grout line between adjacent objects in the finished settable material.

7. A retaining bracket as defined in claim 6 wherein the cap portion includes an elongated ridge extending inwardly toward the recess for contacting and retaining the object within the bracket.

8. A bracket system for retaining an object having a face surface defining a perimeter edge, said face surface being held in a desired position adjacent to the inside surface of a construction form for receiving a settable material whereby the object will be embedded and the face surface exposed in the outer surface of a finished structure, said bracket system comprising:

a) an object;

b) at least two perimeter members joined together to form a perimeter configuration and having a recess area, said perimeter configuration being sized and shaped to closely fit the perimeter edge of the face surface of said object;

c) the perimeter members having a cross-section which includes a flange area which extends inwardly into the recess area to support and contact the perimeter edge of the object positioned in the recess area;

d) each of said perimeter members includes an extended surface which extends outwardly from said flange area to an outer mating surface, said outer mating surface including a coupling means whereby adjacent brackets can be connected together in an assemblage forming a desired pattern by the objects when embedded in the surface of the finished structure;

e) means for attaching the object in the recess area of the bracket so that the object will be held in position with respect to the form during the pouring and setting of the settable material;

f) said attaching means is releasable so that the bracket can be removed from the object when the form is removed from the finished structure; and g) each of said perimeter members includes a base portion and a cap portion, the base portion is formed from a substantially rigid material and has a cross-section having a flanged area for contacting the perimeter edge of the face surface of the object and an outer mating surface for contacting an adjacent bracket extending substantially upright from a plane through the flanged area, a cap portion being formed from a flexible, resilient material which is bonded to said base portion, said cap portion having an outer mating surface extension of the mating surface of the base portion which extends to an outer edge and an extended surface extending from the flange area to said outer mating surface edge whereby the cross-section of the perimeter form member forms one-half of a mold so that in conjunction with an adjacent bracket a grout line will be formed in the finished structure between adjacent embedded objects.

9. A bracket system as defined in claim 8 wherein the mating surface of the cap portion is angled outward from the perimeter member to form a seal with an adjacent bracket.

10. A bracket system as defined in claim 8 wherein the mating surface of the base portion is flat.

11. A bracket system as defined in claim 8 wherein the extended surface of the cap portion of at least one perimeter member has a ridge extending inward toward the recess area to contact the object and form an attaching means for attaching the object within the bracket.

12. A bracket system as defined in claim 11 wherein the cap portion of all perimeter members has a continuous elongated ridge extending around the inside edge of the members for attaching the object to the bracket.

* * * * *

UNITED STATES PATENT AND TRADEMARK OFFICE

CERTIFICATE OF CORRECTION

PATENT NO. : 5,922,235

DATED : July 13, 1999

INVENTOR(S) : Samuel C. Scott and William C. Scott, III

It is certified that error appears in the above-indentified patent and that said Letters Patent is hereby corrected as shown below:

Column 10, line 52, change "48" to --50--

Column 10, line 55, change "48" to --50--

Column 14, line 22, delete "155"

Column 14, line 25-26, delete "to extend inwardly toward the recess"

Column 14, line 26, before "retaining" insert --flexible--

Column 14, line 26, change "ridge" to --member--

Column 14, line 62, change "152" to --156--

Column 18, line 6, change "object" to --brick paver--

Column 18, line 11, change "object to" to --brick paver within--

Column 20, line 11, change "the" (second occurrence) to --at least one—

Column 20, line 23, change "to" to --within--

UNITED STATES PATENT AND TRADEMARK OFFICE

CERTIFICATE OF CORRECTION

PATENT NO. : 5,922,235

DATED : July 13, 1999

INVENTOR(S) : Samuel C. Scott and William C. Scott, III

It is certified that error appears in the above-indentified patent and that said Letters Patent is hereby corrected as shown below:

Column 17, line 40, delete "the support surface of"

Column 17, line 47, change "portions" to --portion--

Column 17, line 49, change "having a" to --forming the--

Column 17, line 58, change "the" (second occurrence) to --an--

Change 17, line 61, change "and" to --an--

Column 18, line 17, delete "configuration"

Column 18, line 21, delete "the outer configuration of"

Column 18, line 28, change "outer" to --perimeter--

Column 18, line 29, before "members" insert --perimeter--

Column 20, line 2-3, delete "which extends to an outer edge"

Column 20, line 4, before "said outer" insert --an edge of--

UNITED STATES PATENT AND TRADEMARK OFFICE

CERTIFICATE OF CORRECTION

PATENT NO. : 5,922,235

DATED : July 13, 1999

INVENTOR(S) : Samuel C. Scott and William C. Scott, III

It is certified that error appears in the above-indentified patent and that said Letters Patent is hereby corrected as shown below:

Column 20, line 5, delete "edge"

Column 20, line 6, delete "form"

Signed and Sealed this

Twenty-third Day of November, 1999

*Attest:*

Q. TODD DICKINSON

*Attesting Officer*

*Acting Commissioner of Patents and Trademarks*